US005938886A

United States Patent [19]

Linder

[11] Patent Number: 5,938,886

[45] Date of Patent: Aug. 17, 1999

[54] MACHINE FOR PRODUCING A BOARD- OR PANEL-SHAPED WOODEN ELEMENT

[75] Inventor: Johnny Linder, Hanaskog, Sweden

[73] Assignee: Tarkett AB, Hanaskog, Sweden

[21] Appl. No.: 08/945,355

[22] PCT Filed: Mar. 26, 1996

[86] PCT No.: PCT/SE96/00378

§ 371 Date: Oct. 24, 1997

§ 102(e) Date: Oct. 24, 1997

[87] PCT Pub. No.: WO96/33849

PCT Pub. Date: Oct. 31, 1996

[30] Foreign Application Priority Data

Apr. 27, 1995 [SE] Sweden ..... 9501552

[51] Int. Cl.[6] ..... B26D 5/38

[52] U.S. Cl. ..... 156/353; 156/510; 156/529; 156/545

[58] Field of Search ..... 156/353, 510, 156/529, 544, 545

[56] References Cited

U.S. PATENT DOCUMENTS

| | | | |
|---|---|---|---|
| 2,687,754 | 8/1954 | McFall | 156/545 |
| 3,547,735 | 12/1970 | Ortel | 156/545 X |
| 3,616,065 | 10/1971 | Larson | 156/544 X |
| 5,009,740 | 4/1991 | Yanai | 156/353 |

FOREIGN PATENT DOCUMENTS

| | | | |
|---|---|---|---|
| 961175 | 5/1950 | France | 156/545 |
| 2 151 979 | 7/1985 | United Kingdom . | |

*Primary Examiner*—Mark A. Osele

*Attorney, Agent, or Firm*—Finnegan, Henderson, Farabow, Garrett & Dunner, L.L.P.

[57] ABSTRACT

A machine for producing a wooden element made up of parallel rows of bars comprises a tape-applying device intended for such application of a strip of adhesive tape on pairs of adjacent rows in parallel therewith that the strip of adhesive tape joins the rows together, as well as a cutting device intended to cut the material web made up of the thus-joined bar rows into predetermined lengths. The cutting device has a reciprocatingly movable carriage provided with a rear cutting unit and a front stop element, the distance between the latter being adjustable according to the aimed-at cutting length. When fed forwards, the material web impinges upon the stop element, thereby to displace the carriage from an initial position to a turning position. The cutting unit performs a cutting operation during this displacement of the carriage. Before the carriage reaches its turning position, the stop element is removed in order to release the cut-off length of material web, thus enabling it to be discharged from the machine. A discharge conveyor discharges the cut-off length of material web at a speed exceeding that at which the material web is fed in the remainder of the machine. A return element returns the carriage to its initial position.

2 Claims, 4 Drawing Sheets

20
24
26
29a
31
38
30
39
40
37
29c
29
29b
25
35
34
28
41
27
32
36
33
33'
23

20
24
29a
39
40
38
30
31
29c
37
26
29
29b
25
35
34
28
41
27
32
36
33
33'
23

24
29a
39
40
20
26
29c
38
30
31
29
29b
37
25
35
34
28
41
27
32
36
33
33'
23

MACHINE FOR PRODUCING A BOARD- OR PANEL-SHAPED WOODEN ELEMENT

The present invention relates to a machine for producing a board- or panel-shaped wooden element which consists of at least two parallel rows of bars and which is especially intended to be glued to at least one other board- or panel-shaped wooden element, thereby to form a building element for the production of a laminated wooden floor, such as a parquet floor.

In a prior-art method for producing a wooden element of the above type, the rows of bars are placed next to one another, whereupon a zigzag glue thread is applied along the joint between the rows in each pair of adjacent rows, thereby to join the latter. The glue thread is applied on that side of the bars which is to face the board- or panel-shaped wooden element to which the wooden element produced as above is later to be glued. The zig-zag glue thread applied is able to keep the adjacent bar rows together when the bars are relatively thin. However, this known method of production cannot be employed when the bars have a thickness exceeding approximately 1 mm, since the resulting board- or panel-shaped wooden element then cannot be handled in a suitable fashion without breaking.

In a known manner for producing a board- or panel-shaped wooden element which is of the above type and whose bar rows are kept together in a reliable fashion even when the bars have a thickness of a few millimetres, the bar rows are placed next to one another, and a strip of adhesive tape is applied on each pair of adjacent rows in parallel therewith and in such a manner as to cover the joint between the rows, thereby joining the latter.

The object of this invention is to provide a continuously operating machine for implementing the last-mentioned method.

According to the invention, this object is achieved by a machine which is characterised in that it has a feeding path for continuously feeding at least two adjacent rows of adjoining bars, a tape-applying device for applying a strip of adhesive tape on each pair of adjacent rows in parallel with these in such a manner that the strip of adhesive tape covers the joint between said rows in order to join the rows together, and a cutting device for cutting the continuous material web made up of the joined bar rows into predetermined lengths, said cutting device having a carriage which is reciprocatingly movable along the feeding path between a rear initial position and a front turning position, a cutting unit mounted on the rear portion of the carriage, and a stop means mounted on the front portion of the carriage, the distance between the cutting unit and the stop means being adjustable according to the aimed-at cutting length, that the stop means in the initial position of the carriage is so placed in relation to the feeding path that the material web will, during the feeding operation, come to be applied against the stop means with its front end so as to displace the carriage from its initial position to its turning position, that the cutting unit is adapted to perform a cutting operation during this displacement of the carriage, that the stop means is adapted, before the carriage reaches its turning position, to be removed from the feeding path, thereby to release the cut-off length of material web so that this can be discharged from the machine, that a discharge conveyor is adapted to discharge the cut-off length of material web at a speed exceeding that at which the material web is fed in the remainder of the machine, and that a return means is adapted to return the carriage to its initial position.

The invention will now be described in more detail with reference to the accompanying drawings, in which FIG. 1 is a schematic side view showing a machine according to the invention;

Figure 1:
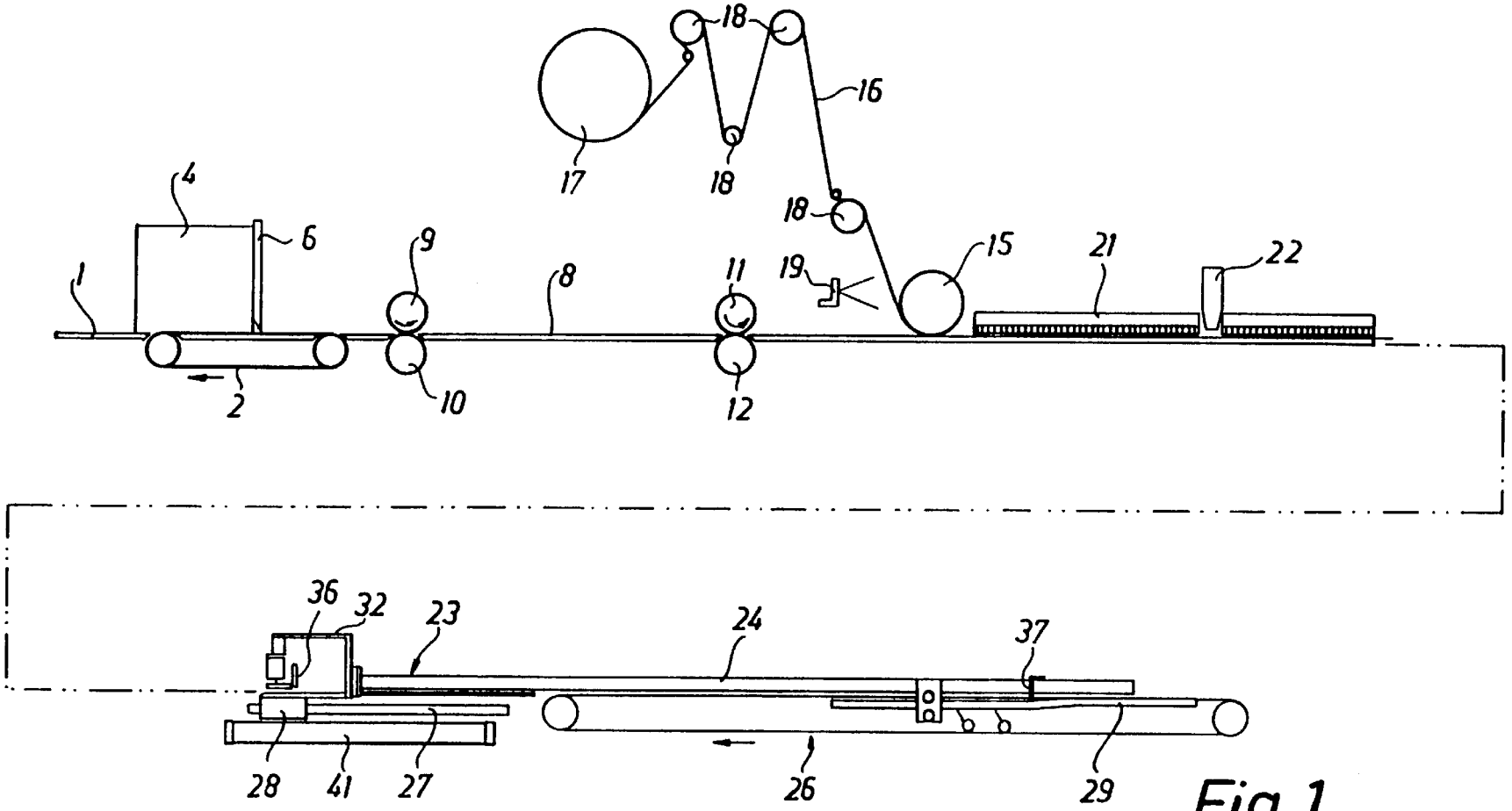
Figure 2:
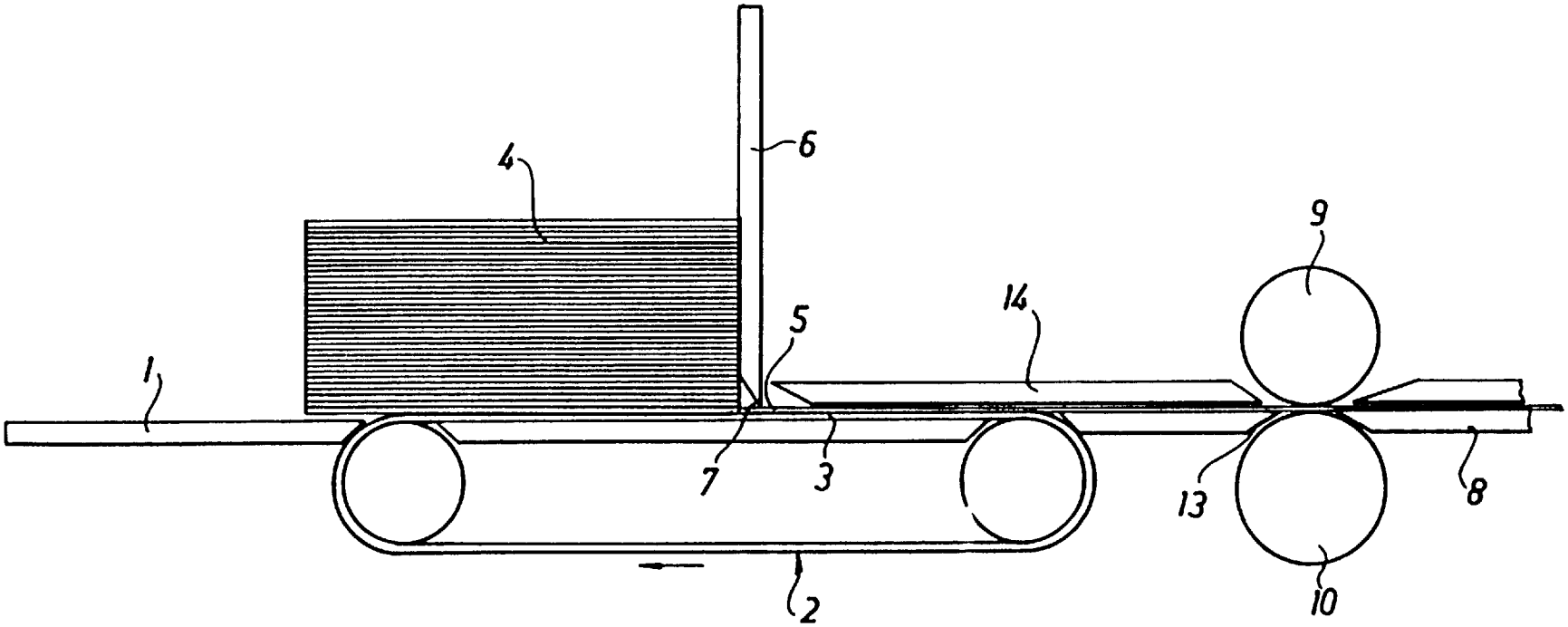
FIG. 2 is an enlarged side view showing the inlet end of the machine.

At its inlet end (FIG. 2), the illustrated machine has a feeding table 1 and a feeding conveyor 2, which is in the form of an endless conveyor belt having a horizontal upper run 3. Two juxtaposed stacks 4 of wooden bars 5 rest on the upper run 3 of the conveyor belt and are driven thereby in their longitudinal direction towards a stop 6. Between the stop 6, which is vertically adjustable, and the upper run 3, there is provided a feeding gap 7 which is adjustable by vertical adjustment of the stop and whose height only slightly exceeds the thickness of the bars 5, thus enabling the feeding of but one bar 5 at a time (the lowermost) from each stack 4.

The feeding conveyor 2 is followed by a feeding path extending along the machine and being in the form of a slide table 8. The bars 5 fed from each stack 4 form a bar row, which is transferred onto the slide table 8. The two bar rows are pressed against one another with the aid of guiding rules (not shown) arranged along the sides of the slide table 8. Two pairs of rubber-clad cylinders 9, 10 and 11, 12 arranged in succession drive the two bar rows forward along the slide table 8. The lowermost cylinder 10, 12 of each pair of cylinders is placed in a recess 13 (FIG. 2) in the slide table 8. The uppermost cylinder 9, 11 of each pair of cylinders is rotated with the aid of a motor (not shown). The cylinders 9, 10 and 11, 12 of each pair of cylinders form a feeding nip, through which pass the two bar rows. The uppermost cylinder 9 of the cylinder pair 9, 10 located upstream is driven at a slightly higher peripheral speed than is the uppermost cylinder 11 of the cylinder pair 11, 12 located downstream. As a result, the bars 5 in each of the bar rows are pressed against each other in the longitudinal direction. A metal sheet 14 is arranged above the slide table 8 in order to prevent the bars 5 in the two rows from rising at their edges when pressed against one another in the lateral as well as the longitudinal direction.

A rubber-clad tape-application cylinder 15, which is freely rotatable, is disposed after the two cylinder pairs 9, 10 and 11, 12. The cylinder 15 is pressed against the bar rows with the aid of a cylinder assembly (not shown). A strip of adhesive tape 16 is unwound from a roller 17 provided above the slide table 8 and is, via a plurality of guide rollers 18, conducted into the nip between the cylinder 15 and the bar rows in order to be continuously applied on the latter.

The strip of adhesive tape 16 consists of a strip of kraft paper which on one side is provided with a gumming. A nozzle 19 adapted to spray water having a temperature approximately 50° C. onto the gumming of the strip of adhesive tape 16 is arranged slightly upstream from the tape-application cylinder 15. The strip of adhesive tape 16 is so applied on the bar rows as to cover the joint therebetween.

A brush mat 21 applied against the upper side of the continuous material web 20 formed of the bar rows joined by tape is arranged after the tape-application cylinder 15 in order to press the strip of adhesive tape 16 against the bar rows. The brush mat 21 extends from the tape-application cylinder 15 to the downstream end of the slide table 8. A hot-air unit 22 is arranged in an opening in the brush mat 21.

This unit 22 blows hot air having a temperature of approximately 180° C. towards the strip of adhesive tape 16 in order to dry it. As a result of this hot-air drying, the strip of adhesive tape 16 contracts and presses the bars in the two rows properly against one another.

Figure 3:
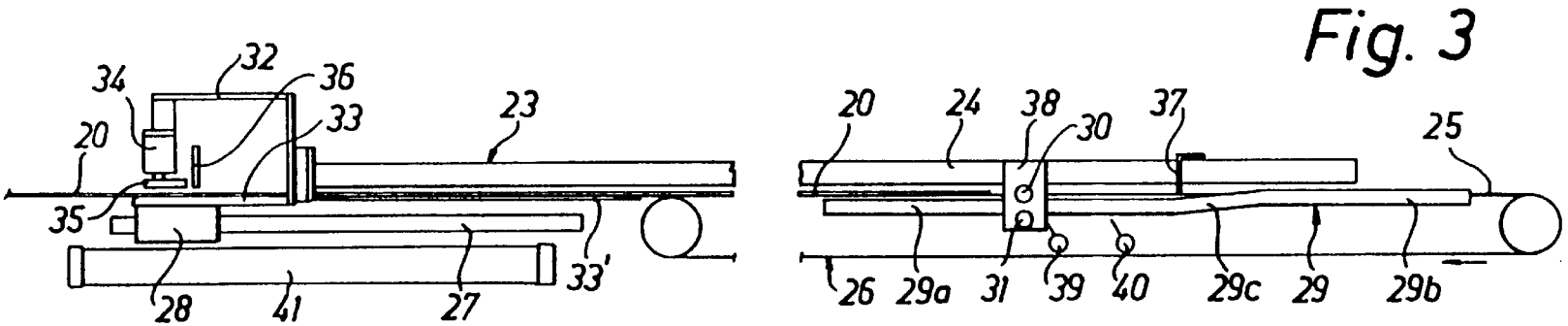
FIGS. 3, 4 and 5 are side views showing on a larger scale a cutting device forming part of the machine of FIG. 1, said cutting device being shown in a rear initial position, an intermediate position and a front turning position.
Figure 5:
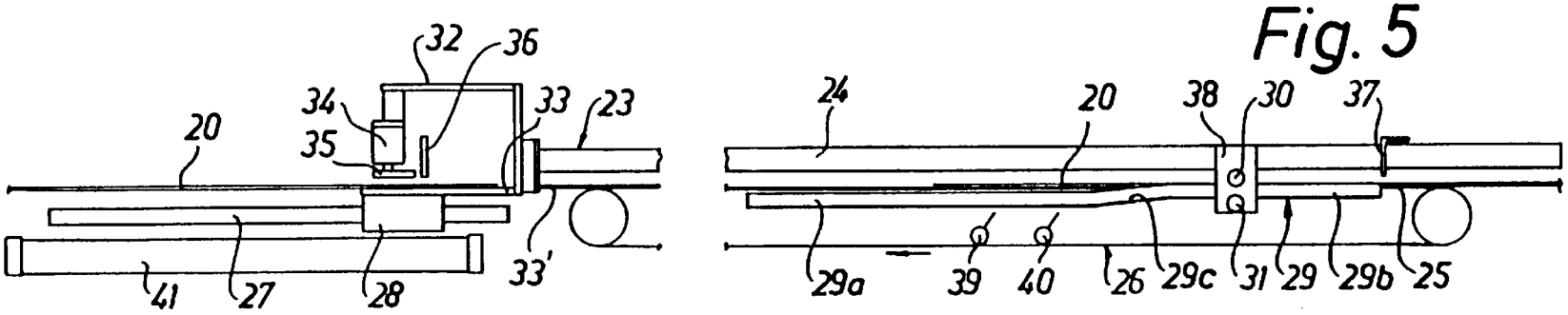

After the brush mat 21, there is provided a cutting device 23 intended to cut into predetermined lengths-the continuous material web 20 made up of the joined bar rows. The cutting device 23 has a carriage 24, which can be moved to and fro along the feeding path between a rear initial position (FIG. 3) and a front turning position (FIG. 5). At the outlet end of the machine, the feeding path consists of a horizontal upper run 25 of a discharge conveyor 26 in the form of an endless conveyor belt.

At the rear portion, the carriage 24 is slidably mounted on two horizontal, rear guiding rods 27, which are arranged one on each side of the machine. The carriage 24 is mounted on the guiding rods 27 by means of ball bushings 28. At the front portion, the carriage 24 is displaceably mounted on two front guiding rods 29, which are arranged one on each side of the machine. The carriage 24 is mounted on the guiding rods 29 by means of roller pairs, the rollers 30, 31 of which are disposed one on each side of the respective guiding rods 29. Each of the front guiding rods 29 has a horizontal rear portion 29*a*, a horizontal front portion 29*b* located in a slightly more elevated position, as well as an intermediate ramp portion 29*c*.

A cutting unit 32 is mounted on the rear portion of the carriage 24. This cutting unit 32 comprises a table 33 which, along with an extension metal sheet 33', forms part of the feeding path, a cylinder assembly 34 having a down-wardly projectable retention stamp 35, and a vertically movable knife means 36 cooperating with a slit (not shown) in the table 33, thereby to cut the material web 20.

Figure 4:
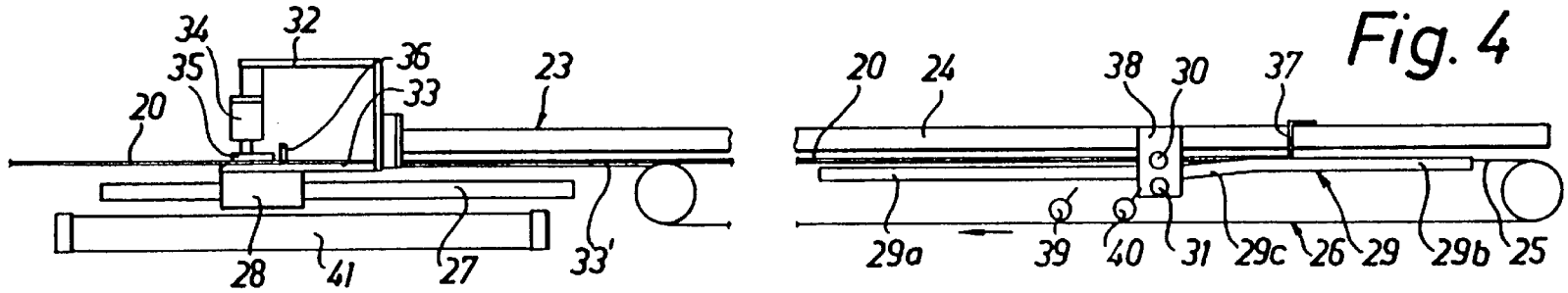

A stop means 37 is adjustably mounted on the front portion of the carriage 24 in such a manner that the distance between the cutting unit 32 and the stop means 37 can be adjusted according to the aimed-at cutting length, which is equal to the distance between the knife means 36 and the stop means 37. When the carriage 24 occupies its initial position (FIG. 3), the stop means 37 is so positioned in relation to the feeding path, i.e. here the upper run 25 of the discharge conveyor 26, that the material web 20 will, during the feeding operation, come to be applied against the stop means 37 with its front end. When this happens, the stop means 37 and, hence, the carriage 24 and the cutting unit 32 mounted thereon are entrained in the feeding movement of the material web. During this forward displacement of the carriage 24, an attachment 38 for the one roller pair 30, 31 mounted on one side of the carriage first acts upon a first micro-switch 39, causing the stamp 35 to be projected into application against the material web 20 in order to press this against the table 33, and then acts upon a second microswitch 40, causing the knife means 36 to move downwards in order to cut off a length of the material web 20 determined by the distance between the stop means 37 and the knife means 36 (see the intermediate position for the carriage 24 illustrated in FIG. 4). During these operations, the two roller pairs 30, 31 of the carriage 24 are, as shown in FIG. 4, located in the rear portion 29*a* of the guiding rods 29. After the cutting operation has been completed, both the knife means 36 and the stamp 35 are returned to their respective upper positions. When the carriage 24 is further displaced in the forward direction, the two roller pairs 30, 31 reach the intermediate ramp portion 29*c* of the guiding rods 29, the front portion of the carriage 24 and, hence, the stop means 37 are raised to such an extent that the stop means 37 releases the cut-off length of material web. This is then discharged from the machine with the aid of the discharge conveyor 26, which is driven at a much higher speed than is the preceding feeding unit, i.e. the roller pair 11, 12.

When the carriage 24 has reached its front turning position (FIG. 5), in which the roller pairs 30, 31 are located in the front portion 29*b* of the guiding rods 29, it is, with the aid of a cylinder assembly 41, returned to its initial position (FIG. 3), whereupon the cutting operation described above is repeated.

Figure 6:
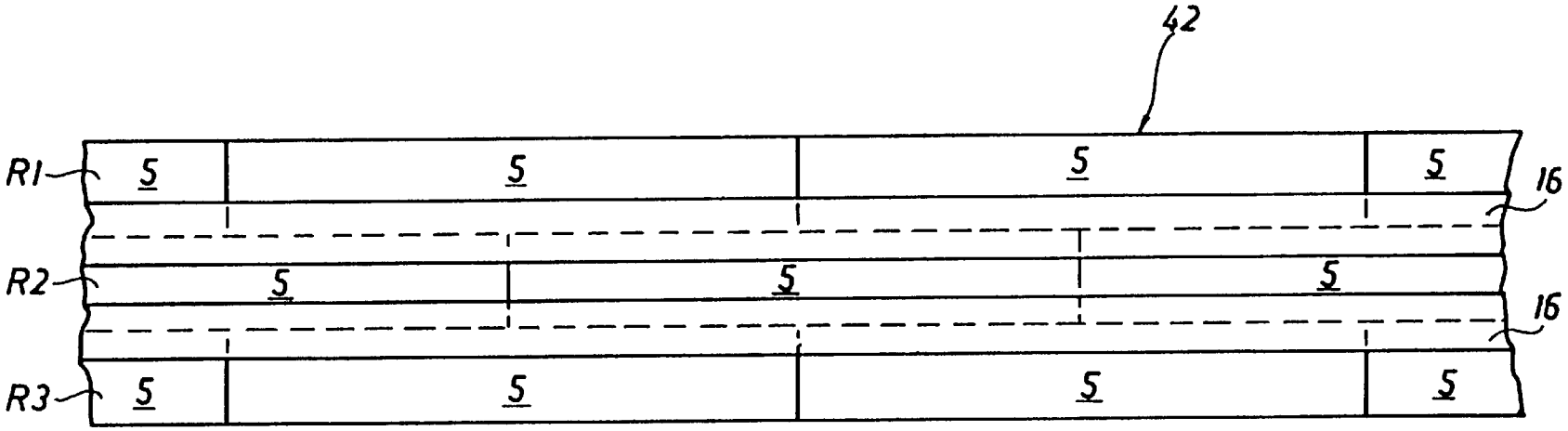
FIG. 6 is a top plan view showing part of a wooden element produced in the machine according to the invention.

The machine described in the foregoing is intended for the production of board-shaped wooden elements consisting of two parallel rows of bars. It will be appreciated that the machine according to the invention may also be used for producing board- or panel-shaped wooden elements consisting of three or more rows of bars. Usually, board-shaped wooden elements made up of three bar rows are produced, the bars of adjacent rows being preferably offset in relation to one another in the longitudinal direction. FIG. 6 illustrates part of such a wooden element 42 comprising three rows R1, R2, R3 of bars 5. This wooden element 42 is produced in a machine that differs from the machine illustrated in FIGS. 1–5 and described above only in that it supports, at its inlet end, three juxtaposed stacks 4 of wooden bars 5 and in that it comprises an additional roller 17, from which is unwound a strip of adhesive tape 16.

The board-shaped wooden element 42 shown in FIG. 6 is to form a wear layer in a board-shaped building element intended for the production of a laminated wooden floor, such as a parquet floor. This building element consists of three glued-together layers, namely a bottom veneer layer, an intermediate veneer layer and the wear layer formed by the wooden element 42. A method of producing such a building element is disclosed in SE Patent Application 9501089-8.

I claim:

1. A machine for producing a board- or panel-shaped wooden element (42) which consists of at least two parallel rows (R1, R2, R3) of bars (5) and which is especially intended to be glued to at least one other board- or panel-shaped wooden element, thereby to form a building element for the production of a laminated wooden floor, characterised in that it has a feeding path (3, 8, 33, 33', 25) for continuously feeding at least two adjacent rows (R1, R2, R3) of adjoining bars (5), a tape-applying device (15, 17, 18, 19) for applying a strip of adhesive tape (16) on each pair of adjacent rows (R1, R2, R3) in parallel with these in such a manner that the strip of adhesive tape (16) covers the joint between said rows in order to join the rows together, and a cutting device (23) for cutting the continuous material web (20) made up of the joined bar rows (R1, R2, R3) into predetermined lengths, said cutting device (23) having a carriage (24) which is reciprocatingly movable along the feeding path between a rear initial position and a front turning position, a cutting unit (32) mounted on the rear portion of the carriage (24), and a stop means (37) mounted on the front portion of the carriage (24), the distance between the cutting unit (32) and the stop means (37) being adjustable according to the aimed-at cutting length, that the stop means (37) in the initial position of the carriage (24) is so placed in relation to the feeding path (25) that the material web (20) will, during the feeding operation, come to be applied against the stop means (37) with its front end so as to displace the carriage (24) from its initial position to its turning position, that the cutting unit (32) is adapted to perform a cutting operation during this displacement of the carriage (24), that the stop means (37) is adapted, before the carriage (24) reaches its turning position, to be removed from the feeding path (25), thereby to release the cut-off length of material web so that this can be discharged from the machine, that a discharge conveyor (26) is adapted to discharge the cut-off length of material web at a speed exceeding that at which the material web is fed in the remainder of the machine, and that a return means (41) is adapted to return the carriage (24) to its initial position.

2. A machine as set forth in claim 1, characterised in that the carriage (24) at its front portion is displaceably mounted on two guiding rods (29) by means of rollers (30, 31), that each of the guiding rods (29) has a horizontal rear portion (29*a*), a horizontal front portion (29*b*) located in a slightly more elevated position, and an intermediate ramp portion (29*c*), and that the rollers (30, 31) are adapted, when reaching the intermediate ramp portion (29*c*) of the guiding rods (29) during the forward displacement of the carriage (24), to raise the front portion of the carriage, hence removing the stop means (37) from the feeding path (25).

* * * * *